United States Patent [19]

Sumi et al.

[11] Patent Number: 4,666,827

[45] Date of Patent: May 19, 1987

[54] SILVER HALIDE PHOTOGRAPHIC EMULSION

[75] Inventors: Seiichi Sumi; Katsuaki Iwaosa, both of Nagaokakyo, Japan

[73] Assignee: Mitsubishi Paper Mills, Ltd., Tokyo, Japan

[21] Appl. No.: 755,310

[22] Filed: Jul. 15, 1985

[30] Foreign Application Priority Data

Jul. 16, 1984 [JP] Japan ..... 59-147109
Jul. 16, 1984 [JP] Japan ..... 59-147110

[51] Int. Cl.[4] ..... G03C 1/36
[52] U.S. Cl. ..... 430/567; 430/606
[58] Field of Search ..... 430/606, 567

[56] References Cited

U.S. PATENT DOCUMENTS 3,326,687 6/1967 Kalenda ..... 430/606
3,628,958 12/1971 Haefner ..... 430/606
3,671,254 6/1972 Dostes ..... 430/606
4,452,882 6/1984 Akimura et al. ..... 430/266
4,472,497 9/1984 Kitchin et al. ..... 430/606

FOREIGN PATENT DOCUMENTS 56-125734 10/1981 Japan ..... 430/606
56-149030 11/1981 Japan ..... 430/606

*Primary Examiner*—Won H. Louie
*Attorney, Agent, or Firm*—Cushman, Darby & Cushman

[57] ABSTRACT

Disclosed is a negative fine grain silver halide photographic emulsion capable of afford hard tone and high $D_{max}$ and have a markedly higher sensitivity than convertional roomlight handlable light-sensitive materials and free from defects such as fogging and decrease in sensitivity under roomlight conditions. This emulsion contains at least 70 mol % of silver chloride and an organic desensitizer which has an anodic polarographic potential and a cathodic polarographic potential which when added together give a positive sum, the amount of said organic desensitizer being such that necessary to reduce the sensitivity of said emulsion by not more than log E=1.3 (log E=1.0 in the case of silver chloride). This emulsion may further contain a rhodium salt.

9 Claims, No Drawings

SILVER HALIDE PHOTOGRAPHIC EMULSION

BACKGROUND OF THE INVENTION

This invention relates to a silver halide photographic emulsion and more particularly to a silver halide photographic emulsion used for high speed roomlight handling light-sensitive materials.

Recently, improvement in efficiency of reversing operation has been desired in the field of printing due to complexity of prints, development of scanners, etc. For this purpose, photographic films extremely low in sensitivity, namely, about $10^{-4}$–$10^{-5}$ of that of the conventional reversal film have been developed and these have began to be practically used as reversal films which can be handled under roomlight (under white fluorescent lamp excluding ultraviolet ray), namely, as roomlight handling light-sensitive materials. Properties required for such roomlight handling light-sensitive materials are that they can provide hard tone and sufficient maximum density, they can be handled under roomlight for a long time and they have a high sensitivity to the light sources of printers. However, conventional roomlight handling light-sensitive materials are not satisfactory in these properties.

Generally, such extremely low sensitivity photographic emulsions as can be utilized as roomlight handling light-sensitive materials can be obtained by using inorganic desensitizers such as rhodium salts or organic desensitizers such as pinakryptol yellow. For example, there have been methods for making roomlight handling light-sensitive materials with use of a large amount of rhodium salts (see Japanese Patent Unexamined Publications (Kokai) No. 125734/81, No. 149030/81, No. 190943/83, etc.). According to these methods a rhodium salt is used in silver halide emulsion mainly composed of silver chloride in an amount to reduce the sensitivity of the emulsion about 1/300--about 1/500. However, silver chloride emulsions depressed in their sensitivity with rhodium salts are liable to cause fog when handled under roomlight and especially the fog conspicuously increases with increase in sensitivity.

The invertors have confirmed that when a silver halide emulsion which has nearly the same sensitivity as the above mentioned extremely low sensitivity silver halide emulsions mainly composed of silver chloride and prepared using a rhodium salt is prepared using an organic desensitizer, there can be obtained roomlight handling light-sensitive materials free from the defects caused by use of rhodium salts. However, it has also been found, that the silver halide emulsions prepared using organic desensitizers can provide hard tone and high maximum density because they are mainly composed of silver chloride, but on the other hand they have the new problem that conspicuous decrease in sensitivity occurs during the period from imagewise exposure to development when they are under roomlight condition. There have been various methods proposed to solve this problem (e.g., Japanese Patent Applications No. 31413/83, No. 33600/83, No. 54536/83, No. 39413/84), but according to these methods the problem has not yet been completely solved.

SUMMARY OF THE INVENTION

It is an object of this invention to provide a silve halide photographic emulsion which has solved the above mentioned various problems existing in silver halide emulsions mainly composed of silver chloride for roomlight handling light-sensitive materials and thus can provide hard tone and high maximum density and conspicuous increase of sensitivity and which is neither fogged nor decreased in sensitivity under roomlight.

DESCRIPTION OF THE INVENTION

This invention relates to a negative type fine grain silver halide photographic emulsion which contains at least 70 mol% of silver chloride and a desensitizer, said desensitizer being an organic desensitizer having an anodic polarographic potential and a cathodic polarographic potential which when added together give a positive sum and the amount of said sensitizer being such that necessary to reduce the sensitivity of said emulsion by a value not exceeding log E (E is exposure)=1.3 (low E=1.0 in case of silver chloride emulsion containing substantially no rhodium salt as a desensitizer).

In one preferred embodiment of this invention, there is provided said silver halide photographic emulsion which contains a water soluble rhodium salt in a desensitizing amount in addition to said organic desensitizer.

This invention will be further explained below.

The organic desensitizers used in this invention are those well known to be used for direct-positive silver halide emulsions. That is, the organic desensitizers used in this invention are characterized in terms of their polarographic half-wave potentials, namely, their oxidation reduction potentials determined by polarography.

The organic desensitizers useful for this invention are those which have an anodic polarographic potential and a cathodic polarographic potential which when added together give a positive sum.

The method for measurement of the oxidation reduction potentials is disclosed, for example, in U.S. Pat. No. 3,501,307.

Examples of these organic desensitizers are disclosed in various patents and literatures and they all have the same action in this invention. For example, they are disclosed in Japanese Patent Examined Publications (Kokoku) No. 17595/61, 20261/64, 26751/65, 13167/68, 8833/70, 8746/72, 10197/72, and 37530/75, Japanese Patent Unexamined Publications (Kokai) No. 24734/73, 84639/74 and 142525/81, and U.S. Pat. No. 2,271,229, No. 2,541,472, No. 3,035,917, No. 3,062,651, No. 3,124,458, No. 3,326,687 and No. 3,671,254.

Examples of the desensitizers are shown below.

(D-1): 1,3-Diethyl-1'-methyl-2'-phenylimidazo[4,5-b]quinoxalino-3'-indolocarbocyanine iodide (D-2): Pinakryptol yellow (D-3): 1,1',3,3,3',3'-Hexamethyl-5,5'-dinitroindocarbocyanine p-toluenesulfonate (D-4): 5,5'-Dichloro-3,3'-diethyl 6,6'-dinitrothiacarbocyanine iodide (D-5): 1,1'-Dimethyl-2,2'-diphenyl-3,3'-indolocarbocyanine bromide (D-6): 1,1',3,3'-Tetraethylimidazo[4,5-b]quinoxalinocarbocyanine chloride (D-7): 5-m-Nitrobenzylidene rhodanine (D-8): 6-Chloro-4-nitrobenzotriazole (D-9): 1,1'-Dibutyl-4,4'-bipyridinium dibromide (D-10): 1,1'-Ethylene-2,2'-bipyridinium dibromide (D-11): 4-(p-n-amyloxyphenyl)-2,6-di(p-ethylphenyl)-thiapyrylium perchlorate (D-12): 2-Mercapto-4-methyl-5-nitrothiazole (D-13): 2-(o-Nitrostyryl)-3-ethylbenzothiazolium p-toluenesulfonate (D-14): 2-(p-Nitrostyryl)-quinoline p-toluenesulfonate (D-15): Phenosafranine (D-16): Pinakryptol green (D-17): 2,3-Dimethyl-6-nitro-benzothiazolium p-toluenesulfonate.

The amount of the organic desensitizer is an important feature of this invention and is extremely smaller than one conventionally employed. It should be understood that in one typical example the amount of the organic desensitizer is 1 mg or less per 1 mol of silver halide. The amount cannot be generally specified because it varies depending on the kind of the organic desensitizers, properties of silver halide emulsions, etc., but generally the amount of the organic desnsitizers is about 0.01–about 30 mg, preferably about 0.1–about 10 mg per one mol of silver halide. However, it is appropriate to specify the amount of the organic desensitizer as one which is necessary to reduce the inherent sensitivity of the silver halide emulsion by not more than log E=1.3 (log E=1.0 in case of silver chloride emulsion), namely, not to reduce the inherent sensitivity of the silver halide emulsion to 1/20 or less (1/10 or less in case of silver chloride emulsion).

In general, the amount is such that necessary to reduce the inherent sensitivity of the silver halide emulsion by the range of from log E≈0.2 to log E=1.3 (1.0 in case of silver chloride emulsion), preferably from log E≈0.3 to log E=1.0 (0.9 in case of silver chloride emulsion).

The organic desensitizers may be added at any time before coating of the silver halide emulsion.

When the silver halide emulsion of this invention contains a rhodium salt as an inorganic desensitizer in addition to said organic sensitizer, the amount of the organic desensitizer may also be determined within the above range considering the amount of the rhodium salt, provided that the upper limit in case of silver chloride emulsion is removed.

That is, the amount of the water soluble rhodium salt is about $10^{-5}$ mol or less, generally, about $10^{-5}$–about $10^{-8}$ mol, preferably about $5\times10^{-6}$–about $5\times10^{-8}$ mol per 1 mol of silver halide. Considering this amount the organic desensitizer and the water soluble rhodium salt are used in combination, wherein the total amount of the desensitizer and the rhodium salt should be such that necessary to reduce the inherent sensitivity of the silver halide emulsion used in this invention by a value not exceeding log E=1.3, namely, necessary not to reduce the sensitivity to 1/20 or less.

Water soluble rhodium salts well known in the art may be advantageously used in this invention and representatives thereof are rhodium monochloride, rhodium dichloride, rhodium trichloride, rhodium ammonium chloride, etc.

In general, the rhodium salts are preferably used at the time of precipitation of silver halide or physical ripening, but may also be used at any time thereafter.

The silver halide emulsions used in this invention are negative emulsions of such as silver chloride, silver chlorobromide, silver chloroiodide, and silver chlorobromoiodide which contain at least 70 mol%, preferably 80 mol% of silver chloride. The negative emulsions mean ordinary silver halide emulsions which are distinguished from direct positive silver halide emulsions and which form negative images form a positive original. Content of silver iodide is 0–about 3 mol%, preferably 0–about 1.5 mol%.

The silver halide emulsions used in this invention are preferably of fine grains having an average grain size not more than 0.4 μm, especially 0.1–0.3 μm. It is preferred that at least 90% of the total grain number have a diameter which is within ±10% of the average grain size, i.e., average diameter.

The silver halide emulsions may be prepared by any of known methods such as sequential mixing method, reverse mixing method and double jet method.

Emulsions after subjected to physical ripening are preferably desalted and then coated with addition of necessary additives. The desalting treatment may be omitted.

It is preferred not to effect chemical ripening, but if desired this may be effected.

Furthermore, the silver halide emulsions used in this invention are not spectrally sensitized.

The silver halide emulsion according to this invention may contain any additives normally used in photographic emulsions such as stabilizers, antifoggants, covering power improving agents, irradiation preventing agents, film property improving agents, surfactants, hardeners, matting agents, developing agents, etc. This emulsion is coated on a known support. Other hydrophilic colloid layers such as protective layer, undercoat layer, etc. may also be provided.

The roomlight handling light-sensitive materials according to this invention are exposed to light sources rich in ultraviolet which are mainly used in the field of printing, such as ultra-high pressure mercury lamp, metal halide lamp, etc. Since they are higher in sensitivity more than 10 times that of the conventional roomlight handling light-sensitive material, they can be used with shorter exposing time or lower illumination, resulting in rationalization such as saving in electric power, shortening of operation time, etc.

EXAMPLE 1

A silver chlorobromide emulsion containing 92 mol% of silver chloride was prepared by double jet method to obtain a monodisperse emulsion having an average grain size of 0.2 μm. Inactive gelatin was used as a gelatin. This emulsion was desalted and redissolved, followed by addition of a stabilizer, a hardener and a surfactant. This emulsion was coated, together with a gelatin solution for protective layer, on a polyester film at a coverage of 5 g/m² in terms of silver nitrate and was dried. This was blank sample A. Sample B was prepared in the same manner as for the blank sample A except that $5\times10^{-4}$ mol of rhodium trichloride per 1 mol of silver halide was used at physical ripening. Furthermore, samples C–P were prepared in the same manner as for the blank sample A except that to the silver halide emulsion was added organic sensitizer (D-2) or (D-9) with changing the amount per 1 mol of silver halide as shown in the following Table 1.

TABLE 1

| Samples | (D-2) mg | Samples | (D-9) mg |
|---|---|---|---|
| C | 300 | J | 300 |
| D | 100 | K | 100 |
| E | 30 | L | 30 |
| F | 10 | M | 10 |
| G | 3 | N | 3 |
| H | 1 | O | 1 |
| I | 0.3 | P | 0.3 |

These samples were exposed for sensitometry by a roomlight printer with a 1.5 kW ultra-high pressure mercury lamp source, developed for 2 minutes at 20° C. in D-85 developer, fixed and dried. The gradation gamma (γ), maximum transmission density ($D_{max}$) and relative sensitivity (S) were determined and are shown in Table 2. The minimum transmission density ($D_{min}$) of all of these samples was 0.02. The relative sensitivity (S) was shown by relative value when that of the blank sample A was normalized to be 10,000.

Table 2 also shows the fog (F) ($D_{min}$) of these samples when they were exposed to roomlight of 500 luxes from which ultraviolet ray was removed, namely, fluorescent lamp of Toshiba FL 40 SW NU for one hour and developed in the same manner as above.

Table 2 further shows the desensitization rate (ΔS) when these samples were sensitometrically exposed then exposed to said roomlight for 10 minutes and thereafter developed in the same manner as above. The desensitization rate is shown by the ratio of desensitization when the sensitivity of each sample which was developed immediately after the sensitometric exposure was assumed to be 100.

TABLE 2

| Sample | γ | $D_{max}$ | S | F | ΔS |
|---|---|---|---|---|---|
| A | 4.6 | 4.3 | 10,000 | 4.1 | unmeasurable |
| B | 4.8 | 4.3 | 30 | 0.85 | 0 |
| C | 4.4 | 4.2 | 50 | 0.02 | 95 |
| D | 4.4 | 4.2 | 145 | 0.02 | 77 |
| E | 4.5 | 4.3 | 390 | 0.02 | 38 |
| F | 4.7 | 4.2 | 670 | 0.02 | 2 |
| G | 4.7 | 4.3 | 1,100 | 0.02 | 0 |
| H | 4.7 | 4.3 | 1,800 | 0.02 | 0 |
| I | 4.6 | 4.3 | 3,200 | 0.03 | 0 |
| J | 4.3 | 4.1 | 70 | 0.02 | 92 |
| K | 4.4 | 4.2 | 115 | 0.02 | 85 |
| L | 4.4 | 4.2 | 230 | 0.02 | 58 |
| M | 4.5 | 4.3 | 330 | 0.02 | 45 |
| N | 4.4 | 4.3 | 560 | 0.02 | 4 |
| O | 4.6 | 4.3 | 1,040 | 0.02 | 0 |
| P | 4.6 | 4.3 | 2,300 | 0.02 | 0 |

The comparative sample B which contained rhodium salt showed much fog under roomlight, which increased with decrease of the amount of the rhodium salt.

It is recognized that the samples C, D, E, J, K, L and M which were prepared by reducing the sensitivity of the blank sample by more than log E=1.3 with organic sensitizer (D-2) or (D-9) were strongly desensitized under roomlight. On the other hand, samples F, G, H, I, N, O and P of this invention, although they were of very high sensitivity, caused substantially no fogging and no desensitization under roomlight and moreover were high in gradation and maximum density. Thus, these samples were markedly excellent high sensitivity roomlight haldling light-sensitive materials.

EXAMPLE 2

Example 1 was repeated except that as the organic desensitizer there was added each of (D-7), (D-10), (D-11), (D-13) and (D-16) in an amount of 1 mg per 1 mol of silver halide, whereby samples Q, R, S, T and U were obtained, respectively. The results are shown in Table 3.

TABLE 3

| Samples | γ | $D_{max}$ | S | F | ΔS |
|---|---|---|---|---|---|
| A | 4.6 | 4.3 | 10,000 | 4.1 | Unmeasurable |
| Q | 4.7 | 4.3 | 1,400 | 0.02 | 0 |

TABLE 3-continued

| Samples | γ | $D_{max}$ | S | F | ΔS |
|---|---|---|---|---|---|
| R | 4.6 | 4.3 | 1,600 | 0.02 | 0 |
| S | 4.6 | 4.3 | 2,100 | 0.02 | 0 |
| T | 4.7 | 4.3 | 1,400 | 0.02 | 0 |
| U | 4.6 | 4.3 | 1,900 | 0.02 | 0 |

EXAMPLE 3

The following samples were prepared in the same manner as in Example 1 except that silver chloride of 0.3 μm in the average grain size was used.

| Samples | (D-2) mg | Samples | (D-2) mg |
|---|---|---|---|
| Blank a | non | e | 10 |
| b | 300 | f | 3 |
| c | 100 | g | 1 |
| d | 30 | h | 0.3 |

These samples were tested in the same manner as in Example 1 and the results are shown in Table 4.

TABLE 4

| Sample | γ | $D_{max}$ | S | F | ΔS |
|---|---|---|---|---|---|
| a | 4.9 | 5.1 | 10,000 | 4.6 | Unmeasurable |
| b | 4.8 | 5.0 | 40 | 0.02 | 95 |
| c | 4.8 | 5.0 | 110 | 0.02 | 89 |
| d | 4.8 | 5.1 | 315 | 0.02 | 64 |
| e | 4.9 | 5.0 | 540 | 0.02 | 40 |
| f | 4.8 | 5.2 | 830 | 0.02 | 26 |
| g | 4.8 | 5.2 | 1,200 | 0.02 | 3 |
| h | 4.9 | 5.1 | 2,300 | 0.02 | 0 |

In Table 4, it is recognized that samples g and h in which sensitivity (S) was reduced by not more than log E=1.0 had high sensitivity and showed no fog and no desensitization under roomlight.

EXAMPLE 4

Sample i was prepared in the same manner as in the preparation of blank sample A in Example 1 except that $1\times10^{-6}$ mol of a rhodium trichloride per 1 mol of silver halide was used at physical ripening.

Samples j—m were prepared by using the emulsion of said Example i to which organic desensitizer (D-9) was added with changing the amount as shown below.

| Samples | j | k | l | m |
|---|---|---|---|---|
| (D-9) mg | 10 | 1.8 | 0.45 | 0.15 |

These samples were tested in the same manner as in Example 1 and the results are shown in Table 5.

TABLE 5

| Samples | γ | $D_{max}$ | S | F | ΔS |
|---|---|---|---|---|---|
| i | 4.6 | 4.3 | 1,800 | 3.4 | Unmeasurable |
| j | 4.6 | 4.2 | 80 | 0.02 | 80 |
| k | 4.5 | 4.3 | 350 | 0.02 | 27 |
| l | 4.6 | 4.3 | 900 | 0.02 | 2 |
| m | 4.6 | 4.3 | 1,400 | 0.02 | 1 |

EXAMPLE 5

Example 4 was repeated except that as the organic desensitizer there was added each of (D-2), (D-7), (D-10), (D-11), (D-13) and (D-16) in an amount of 0.45 mg per 1 mol of silver halide, thereby to obtain samples n, o, p, q, r and s, respectively.

The results are shown in Table 6.

TABLE 6

| Sample | $\gamma$ | $D_{max}$ | S | F | $\Delta S$ |
|---|---|---|---|---|---|
| n | 4.7 | 4.3 | 1,300 | 0.02 | 1 |
| o | 4.6 | 4.3 | 1,150 | 0.02 | 2 |
| p | 4.6 | 4.3 | 1,200 | 0.02 | 2 |
| q | 4.7 | 4.4 | 1,450 | 0.02 | 1 |
| r | 4.6 | 4.3 | 1,100 | 0.02 | 3 |
| s | 4.6 | 4.3 | 1,350 | 0.02 | 1 |

EXAMPLE 6

Sample v was prepared using a silver chloride emulsion of 0.3 $\mu$m in average grain size to which rhodium trichloride was added in an amount of $5\times10^{-7}$ mol per 1 mol of silver halide and Samples W–Z were prepared using said silver chloride emulsion to which the organic desensitizer (D-2) was further added in an amount as shown below per 1 mol of silver chloride.

| Samples | V | W | X | Y | Z |
|---|---|---|---|---|---|
| (D-2) mg | — | 10 | 3 | 1 | 0.3 |

These samples were tested in the same manner as in Example 1 and the results are shown in Table 7.

| Sample | S | F | $\Delta S$ |
|---|---|---|---|
| V | 10,000 | 4.4 | Unmeasurable |
| W | 320 | 0.02 | 36 |
| X | 550 | 0.02 | 4 |
| Y | 890 | 0.02 | 2 |
| Z | 1,500 | 0.02 | 1 |

In Table 7, it is recognized that Samples X, Y and Z where the sensitivity (S) was reduced by not more than log E=1.3 had high sensitivity and showed neither fog nor desensitization under roomlight.

As explained above, the silver halide photographic emulsions according to this invention afford hard tone and a high maximum density and have a markedly higher sensitivity than conventional roomlight handling light-sensitive materials and besides are free from defects such as fogging and desensitization under roomlight both before and after imagewise exposure. Therefore, safety in long time handling can be ensured and moreover saving of electric power in printers and improvement of operability can be attained.

What is claimed is:

1. A negative silver halide photographic emulsion which is not spectrally sensitized, has an average grain size of not more than 0.4 $\mu$m and which contains at least 70 mol% of silver chloride and an organic desensitizer which has an anodic polarographic potential and a cathodic polarographic potential which when added together give a positive sum, the amount of said organic desensitizer being such as is necessary to reduce the sensitivity of said emulsion by not more than log E=1.3 (log E=1.0 in the case of silver chloride).

2. A negative silver halide photographic emulsion according to claim 1 wherein the amount of the organic desensitizer is such that necessary to reduce the sensitivity of the emulsion by log E$\approx$0.2 to log E=1.3 (log E$\approx$0.2 to log E=1.0 in the case of silver chloride emulsion).

3. A negative silver halide photographic emulsion according to claim 2 wherein the amount of the organic desensitizer is such that necessary to reduce sensitivity of the emulsion by log E$\approx$0.3 to log E=1.0 (log E$\approx$0.3 to log E=0.9 in case of silver chloride emulsion).

4. A negative silver halide photographic emulsion according to claim 1 wherein the amount of the organic desensitizer is about 0.1–about 10 mg per 1 mol of silver halide.

5. A negative silver halide photographic emulsion according to claim 1 which additionally contains a water soluble rhodium salt as a desensitizer, the total amount of the organic desensitizer and the water soluble rhodium salt being such that necessary to reduce the sensitivity of the silver halide emulsion by not more than log E=1.3.

6. A negative silver halide photographic emulsion according to claim 5 wherein the amount of the water soluble rhodium salt is less than about $10^{-5}$ mol per 1 mol of silver halide.

7. A negative silver halide photographic emulsion according to claim 6 wherein the amount of the water soluble rhodium salt is about $10^{-5}$–about $10^{-8}$ mol per 1 mol of silver halide.

8. A roomlight handling light-sensitive material which comprises a support and a layer coated thereon which comprises the negative silver halide photographic emulsion described in claim 1.

9. A negative silver halide photographic emulsion according to claim 1 wherein the average grain size is 0.1–0.3 $\mu$m.

* * * * *